US008080983B2

(12) United States Patent
Lourens et al.

(10) Patent No.: US 8,080,983 B2
(45) Date of Patent: Dec. 20, 2011

(54) LOW DROP OUT (LDO) BYPASS VOLTAGE REGULATOR

(75) Inventors: Ruan Lourens, Volente, TX (US); Razvan Enachescu, Bucharest (RO); Marc Tiu, Glendale, AZ (US)

(73) Assignee: Microchip Technology Incorporated, Chandler, AZ (US)

( * ) Notice: Subject to any disclaimer, the term of this patent is extended or adjusted under 35 U.S.C. 154(b) by 6 days.

(21) Appl. No.: 12/604,597

(22) Filed: Oct. 23, 2009

(65) Prior Publication Data

US 2010/0109624 A1 May 6, 2010

Related U.S. Application Data

(60) Provisional application No. 61/110,714, filed on Nov. 3, 2008.

(51) Int. Cl.
*G05F 1/565* (2006.01)
*G05F 5/00* (2006.01)

(52) U.S. Cl. ..... 323/275; 323/300

(58) Field of Classification Search ..... 323/273–281, 323/299, 300, 303
See application file for complete search history.

(56) References Cited

U.S. PATENT DOCUMENTS 6,246,221 B1 * 6/2001 Xi ..... 323/280
6,426,670 B1 * 7/2002 Tanaka ..... 327/541
6,465,994 B1 * 10/2002 Xi ..... 323/274
7,548,051 B1 * 6/2009 Tenbroek et al. ..... 323/315
2003/0034760 A1 * 2/2003 Hwang ..... 323/224
2006/0109039 A1 * 5/2006 Wu ..... 327/172
2006/0170401 A1 * 8/2006 Chen et al. ..... 323/273
2006/0197513 A1 9/2006 Tang et al. ..... 323/273
2007/0091527 A1 * 4/2007 Julicher ..... 361/93.1
2009/0218997 A1 * 9/2009 Hey et al. ..... 323/273

OTHER PUBLICATIONS

International PCT Search Report, PCT/US2009/063026, 12 pages, Mailed May 27, 2010.

* cited by examiner

*Primary Examiner* — Adolf Berhane
*Assistant Examiner* — Jeffrey Gblende
(74) *Attorney, Agent, or Firm* — King & Spalding L.L.P.

(57) ABSTRACT

A power element bypass and voltage regulation circuit shutdown is used in a low drop out (LDO) bypass voltage regulator to minimize current drawn by the voltage regulator circuit when the supply input voltage approaches the regulated output voltage of the voltage regulation circuit. Two modes of operation are used in the low drop out (LDO) bypass voltage regulator. A regulate mode is used when the supply input voltage is greater than the reference voltage input, and a track mode is used when the supply input voltage is less than or equal to approximately the regulated output voltage of the voltage regulation circuit. Hysteresis may be introduced when switching between the regulate and track modes of operation.

8 Claims, 5 Drawing Sheets

LOW DROP OUT (LDO) BYPASS VOLTAGE REGULATOR

RELATED PATENT APPLICATION

This application claims priority to commonly owned U.S. Provisional Patent Application Ser. No. 61/110,714; filed Nov. 3, 2008; entitled "Low Drop Out (LDO) Bypass Voltage Regulator," by Ruan Lourens, Razvan Enachescu and Marc Tiu; and is hereby incorporated by reference herein for all purposes.

TECHNICAL FIELD

The present disclosure relates to on chip voltage regulators and, more particularly, to a low drop out (LDO) bypass voltage regulator having low current consumption when in a low drop out bypass mode.

BACKGROUND

Integrated circuit devices are being fabricated with sub-micron processes that cannot operate at voltages much above 3.3 volts. However these integrated circuit devices may be part of electronic systems that function at higher voltages, thus requiring the device to function with a higher voltage power source. This may be accomplished by using an on-chip voltage regulator for reducing the higher voltage of the power source to a safe operating voltage for the sub-micron device. Some voltage regulators require an external decoupling capacitor that requires an external connection on an integrated circuit package of the device. But there are a few on chip voltage regulator designs that are self contained without requiring any externally connected components for transient stability. However this type of on chip voltage regulator will draw an increased amount of current when the input voltage is less than or equal to its output design voltage.

SUMMARY

Therefore, a need exists for an on-board voltage regulator that will drop out (pass current without regulation) at low input voltages without drawing more operating current then when in a normal regulation mode, and, preferably, will draw much less current when not regulating the supply voltage (e.g., when in a drop out mode).

According to the teachings of this disclosure, the aforementioned problems are solved by disabling an on-chip integrated circuit voltage regulator and putting the output power stage(s) into a fully conductive mode when the source voltage (Vin) approaches a certain set-point. In addition, no external pin is required for transient stability of the on-chip voltage regulator.

According to a specific example embodiment of this disclosure, a low drop out (LDO) bypass voltage regulator in an integrated circuit device comprises: a power pass element, the power pass element having a power input, a power output and a control input, wherein the power input is coupled to a voltage source and the power output is coupled to a load; a buffer having an input and an output, wherein the output of the buffer is coupled to the control input of the power pass element; an error amplifier having a positive input, a negative input and an output, wherein the output of the error amplifier is coupled to the input of the buffer, the negative input is coupled to a voltage reference and the positive input is coupled to a sampled voltage of the power output of the power pass element; and a voltage monitor and control circuit having a first control output, a second control output and a voltage sensing input, wherein the voltage sensing input is coupled to the voltage source, the first control output is coupled to the buffer and the second control output is coupled to the power pass element, wherein when the voltage source is above a first voltage value the buffer is enabled, and the power pass element, buffer and error amplifier regulate a load voltage, and when the voltage source is less than a second voltage value the buffer is disabled and the power pass element is placed into a pass-through state so that the load voltage follows the source voltage and is not regulated.

According to another specific example embodiment of this disclosure, a method for a low drop out (LDO) bypass voltage regulator in an integrated circuit device comprises: regulating a load voltage from a source voltage with a power pass element when the source voltage is above a first voltage value; controlling operation of the power pass element with a buffer amplifier, an error amplifier and a voltage reference when the source voltage is above the first voltage value; coupling the load voltage to the source voltage through the power pass element such that the load voltage follows the input voltage when the source voltage is less than a second voltage value; and disabling the buffer amplifier when the source voltage is less than the second voltage value.

BRIEF DESCRIPTION OF THE DRAWINGS

A more complete understanding of the present disclosure may be acquired by referring to the following description taken in conjunction with the accompanying drawings wherein.

Figure 1:
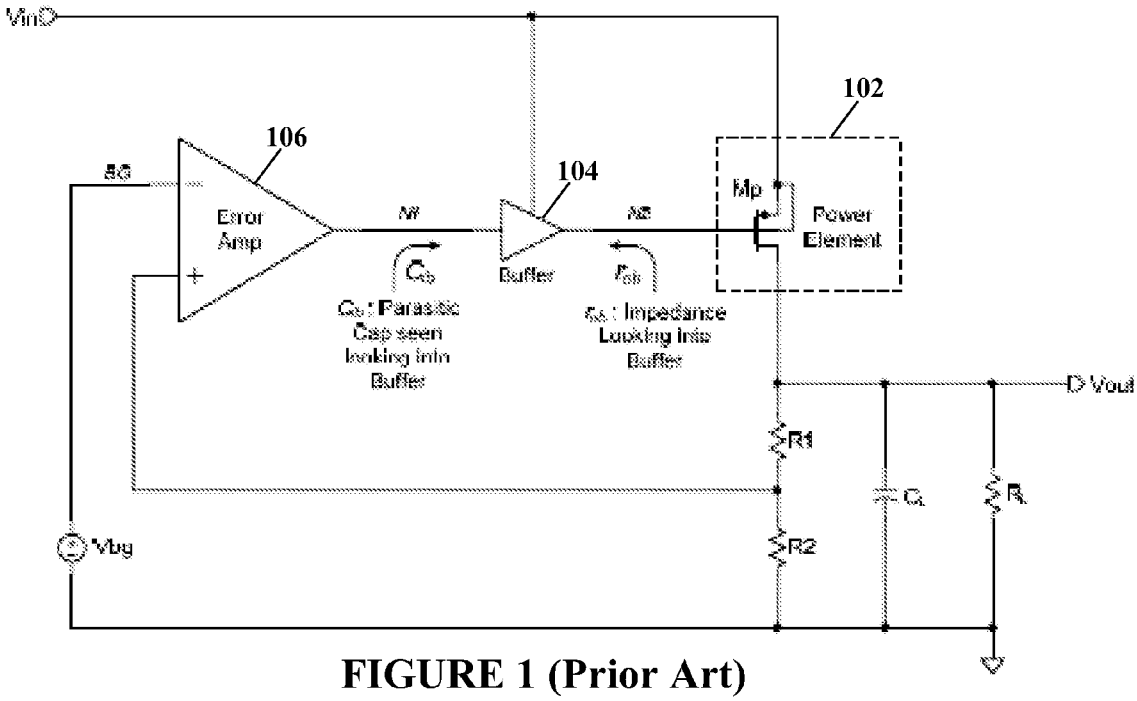
FIGURE 1 (Prior Art)
FIG. 1 illustrates a schematic diagram of a prior art low dropout LDO voltage regulator.

While the present disclosure is susceptible to various modifications and alternative forms, specific example embodiments thereof have been shown in the drawings and are herein described in detail. It should be understood, however, that the description herein of specific example embodiments is not intended to limit the disclosure to the particular forms disclosed herein, but on the contrary, this disclosure is to cover all modifications and equivalents as defined by the appended claims.

DETAILED DESCRIPTION

Referring now to the drawing, the details of specific example embodiments are schematically illustrated. Like elements in the drawings will be represented by like numbers, and similar elements will be represented by like numbers with a different lower case letter suffix.

Referring to FIG. 1, depicted is a schematic diagram of a prior art low dropout LDO voltage regulator.

When the voltage at $V_{OUT}$ is lowered, the corresponding sampled voltage going into the positive input of the error amplifier 106 will also decrease. Now, the positive input voltage becomes lower than the negative input voltage of the error amplifier 106. In effect, this will lower the output of the error amplifier 106 to the buffer amplifier 104 and the same signal will be buffered to the P-channel metal oxide semiconductor (PMOS) transistor power transistor 102. The output of the error amplifier 106 will lower faster if the difference between its inputs is greater. This lower voltage shown at the gate of the PMOS power transistor 102 turns on the PMOS power transistor more, thus allowing the voltage in $V_{IN}$ to charge up the voltage in $V_{OUT}$.

When the $V_{OUT}$ voltage approaches the desired level, the difference between the sampled $V_{OUT}$ voltage and the bandgap voltage becomes less, thereby making the PMOS power transistor 102 shut off. On the other hand, when the voltage at $V_{OUT}$ is increasing, the corresponding sampled voltage fed into the positive input of the error amplifier 106 increases and becomes greater than the reference voltage (Vbg) fed into the negative input of the error amplifier 106. This will increase the output of the error amplifier 106 to the buffer 104 and will be buffered to the PMOS power transistor 102. The output of the error amplifier 106 will increase faster if the difference between its inputs is greater. This higher voltage shown at the gate of the PMOS power transistor 102 turns off the PMOS power transistor 102 more, thus preventing a further increase in voltage at the $V_{OUT}$ node. This whole operation maintains the voltage at $V_{OUT}$ to a desired steady state voltage value.

$V_{IN}$ is the voltage fed to the LDO voltage regulator and it may range from about 0 to 5.5 volts. On the other hand, $V_{OUT}$ is the voltage at the output of the LDO voltage regulator and is used to power logic circuits of an integrated circuit device (not shown). The LDO voltage regulator of FIG. 1 has a preferred output voltage range of from about 3.0 to about 3.6 volts. When the input voltage, $V_{IN}$, is above about 3.7 volts, the majority of the current consumption is due to the integrated device's normal operation (e.g., logic circuit transistor switching load). The voltage regulator current is kept to a minimum relative to the integrated circuit device logic circuits operating current at this point. However, a problem occurs when the $V_{IN}$ node is at about 3.6 volts or less. The circuit shown in FIG. 1 has to work harder to make the voltages of $V_{IN}$ and $V_{OUT}$ the same. Due to the dynamic requirements for this LDO voltage regulator, an output driver with a diode-connected buffer configuration preferably is most stable for the application as part of an on-chip voltage regulator, instead of a conventional push-pull output stage. However, an undesirable effect of this circuit is high quiescent current from the diode connected buffer amplifier 104 when it drives the gate of the PMOS power transistor 102 towards power common (e.g., ground). This happens when $V_{IN}$ gets close to $V_{OUT}$ and the PMOS power transistor 102, goes into its triode region from saturation. This effect is shown as the dashed line in FIG. 6. This effect is very undesirable.

Figure 2:
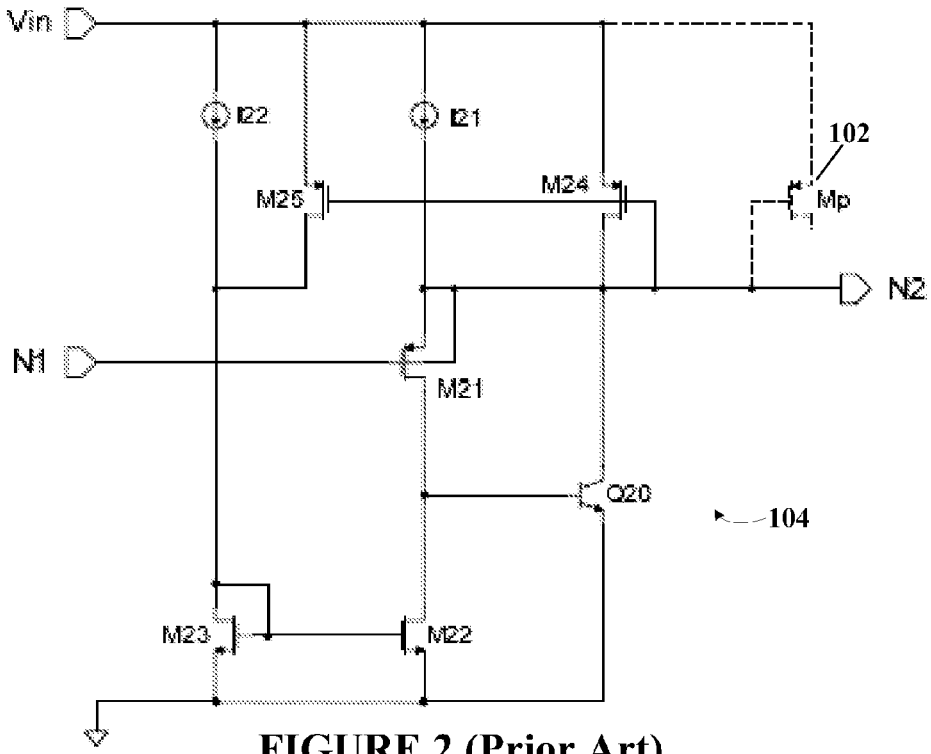
FIGURE 2 (Prior Art)
FIG. 2 illustrates a more detailed schematic diagram of a typical prior art buffer that may be used in the prior art LDO voltage regulator shown in FIG. 1.

FIG. 2 illustrates a more detailed schematic diagram for the buffer 104 of the LDO voltage regulator shown in FIG. 1. The potential high current problem, illustrated in FIG. 6 as line segment 654, occurs in this part of the LDO voltage regulator. When this circuit switches from a regulating mode to a track mode, the voltage $V_{OUT}$ tracks with $V_{IN}$. So when at lower input voltages, e.g., $V_{IN}$ less than about 3.6 volts, the output voltage, $V_{OUT}$, lowers as well, e.g., tracks $V_{IN}$. Since the voltage $V_{OUT}$ is sampled and fed into the positive input of the error amplifier 106, this forces the positive input voltage to be lower than the negative input voltage of the error amplifier 106. This will force a low level signal into the buffer 104. The input node, N1, of the buffer 104 is driven to ground and at the same time, the output node, N2, of the buffer 104 is also driven to ground. When these nodes are low, the PMOS transistors M21, M24 and M25 will turn on harder. Turning on M25 will put a high voltage into the diode connected NMOS transistor M23 and activate the current mirror. When all of these transistors activate, the current consumption of the buffer 104 will greatly increase because the transistors are designed to be able to draw a lot of current so that the buffer 104 is capable of having fast response time.

Forcing a logical 0 on the buffer 104 during this scenario is necessary to drive the gate of the PMOS power transistor 102 to ground and thereby activate it (turn it on hard). This will enable the LDO voltage regulator to go into a track mode, e.g., $V_{OUT}$ will follow $V_{IN}$.

Figure 3:
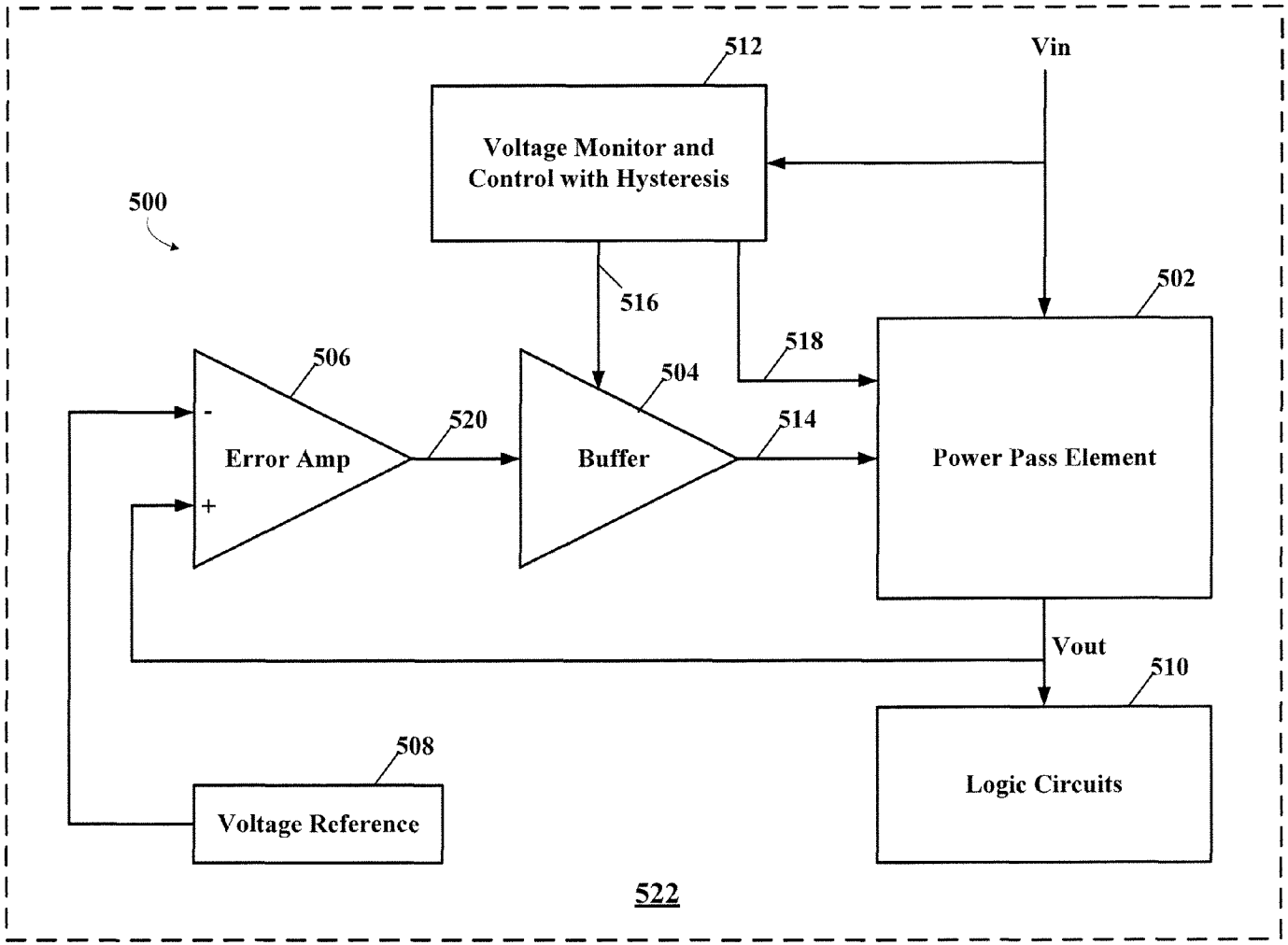
FIG. 3 illustrates a schematic block diagram of an LDO bypass voltage regulator in an integrated circuit device, according to a specific example embodiment of this disclosure.

Referring to FIG. 3, depicted is a schematic block diagram of a low drop out (LDO) bypass voltage regulator in an integrated circuit device, according to a specific example embodiment of this disclosure. The LDO bypass voltage regulator, generally represented by the numeral 500, comprises a voltage reference 508, an error amplifier 506, a buffer 504, a voltage monitor and control circuit 512 and a power pass element 502, all fabricated onto an integrated circuit die 522. The voltage monitor and control circuit 512 may also include voltage hysteresis. The output of the power pass element 502, $V_{OUT}$, is coupled to power consuming logic circuits 510 of the integrated circuit die 522. The voltage reference 508 may be for example but not limited to a bandgap voltage reference.

When the input voltage, $V_{IN}$, is at, for example but not limited to, about 3.6 volts, the voltage monitor and control circuit 512 will force the control node (e.g., gate) of the power pass element 502 (similar to the PMOS power transistor 102 of FIG. 1) to ground through control signal 518. This will cause the power pass element 502 to turn on hard (go into saturation) and effectively short together the $V_{IN}$ and $V_{OUT}$ nodes. Also the buffer 504 will be put into a high impedance state with minimal current consumption with control signal 516 from the voltage monitor and control circuit 512, whereby the current drawn (power consumption) by the integrated circuit device will be mainly from the logic circuits 510 (load). As the input voltage, $V_{IN}$, goes lower, so does the current consumption. This is represented by the dashed line 656 shown in FIG. 6. When the voltage, $V_{IN}$, goes from a lower voltage to about 3.65 volts, the voltage monitor and control 512 re-engages the buffer 504. Thereby enabling the regulation circuit so as to keep $V_{OUT}$ at about 3.3 volts even if $V_{IN}$ goes higher than 3.6 volts. The voltage monitor and control 512 may further have hysteresis so that the power pass element 502 and the buffer 504 will go into the tracking mode at a slightly lower voltage then when going back to the regulate mode of operation.

In order to solve this high current consumption problem, the buffer 504 is shut off when the LDO voltage regulator is in the track mode. The voltage monitor and control circuit 512 determines whether the LDO voltage regulator 500 is in track mode or regulate mode by monitoring the input voltage $V_{IN}$. When the LDO voltage regulator 500 is in the track mode, along with other conditions, it enables (turns on) the power pass element 502, e.g., the PMOS power transistor 102 shown in FIG. 1. In effect, this shorts the $V_{IN}$ and $V_{OUT}$ nets of the LDO voltage regulator 500, enabling the track mode, e.g., pass through of $V_{IN}$ to $V_{OUT}$. When this happens, the power pass element 502 is no longer dependent on the output 514 of the buffer 504 to drive the power pass element 502. Because of this action, the current mirror in the buffer 504 is disabled (signal 516) so as to avoid the aforementioned problem of unnecessarily high current consumption.

Figure 4:
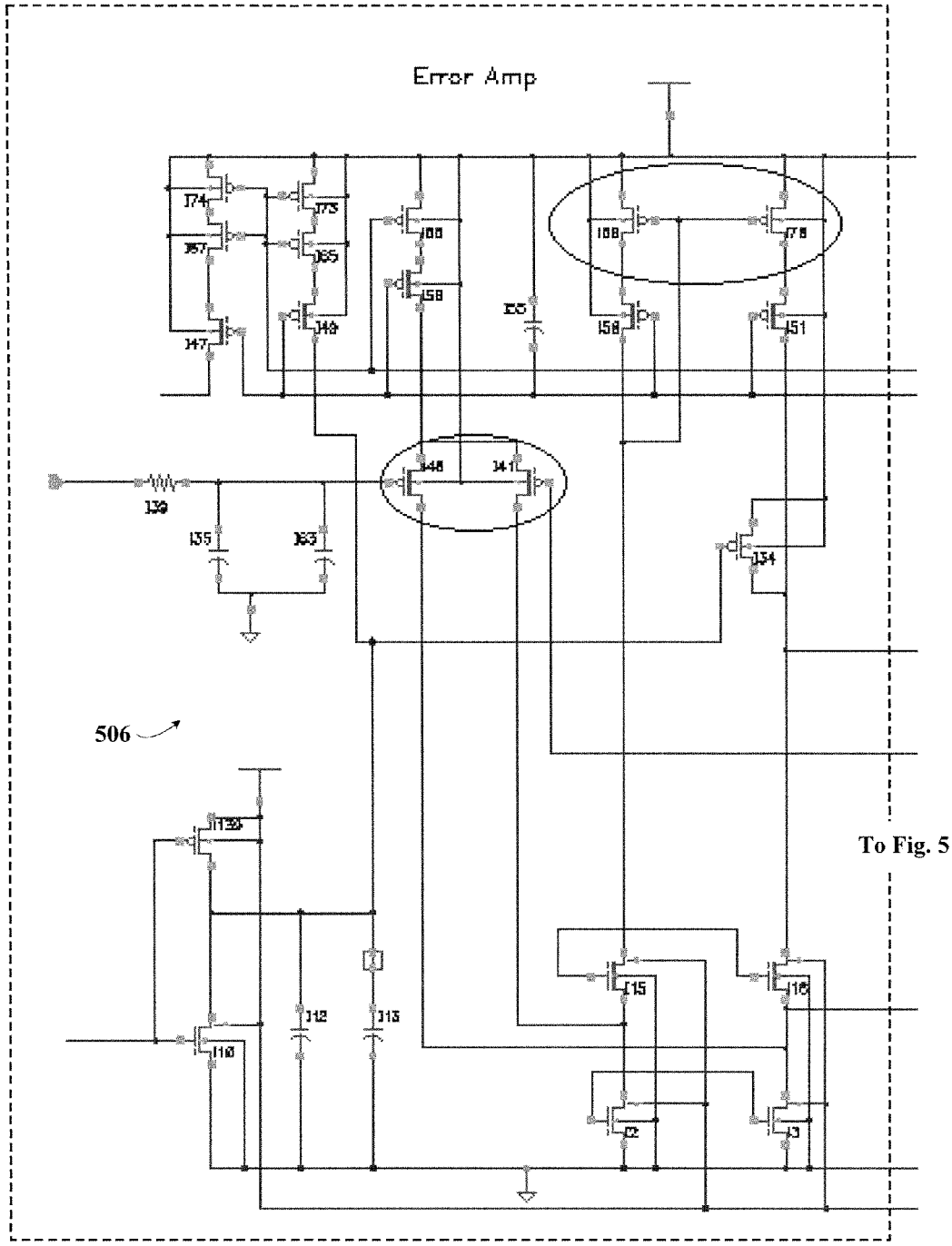
FIGS. 4 and 5 illustrate more detailed schematic diagrams of the error amplifier and buffer of the LDO voltage regulator shown in FIG. 3.
Figure 5:
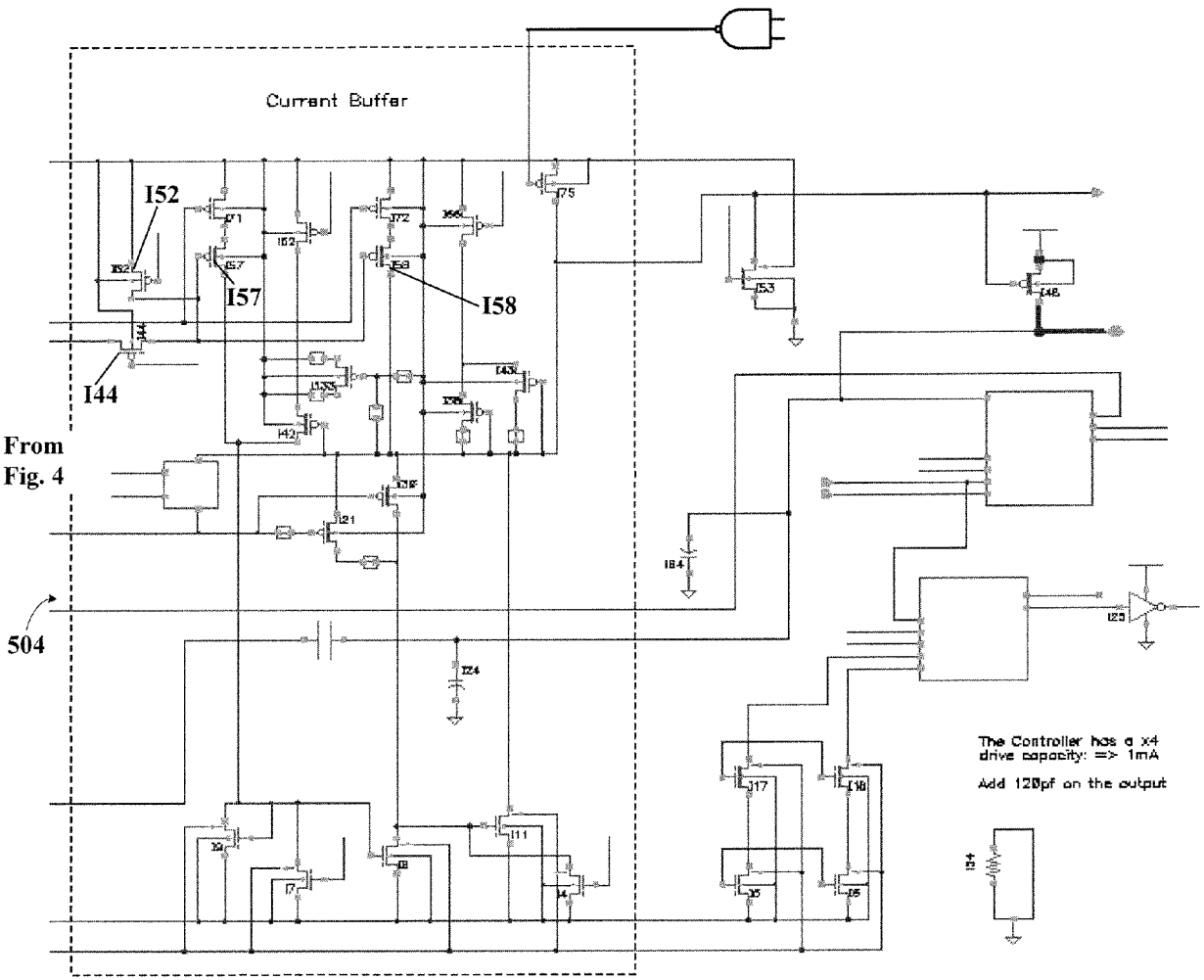

Referring to FIGS. 4 and 5, depicted are more detailed schematic diagrams of the error amplifier and buffer of the LDO voltage regulator shown in FIG. 3. When the LDO bypass voltage regulator 500 detects that the supply voltage is low, it will switch over to the track mode, this also sends a signal to disable the current buffer. When the current buffer is turned off, transistor 144 is switched off to avoid biasing the common gate transistors 157 and 158. At the same time, transistor 152 switches on in order to fully shut down the common gate transistors 157 and 158. This in effect shuts down the cascade circuitry and eliminates the current being supplied by it.

Figure 6:
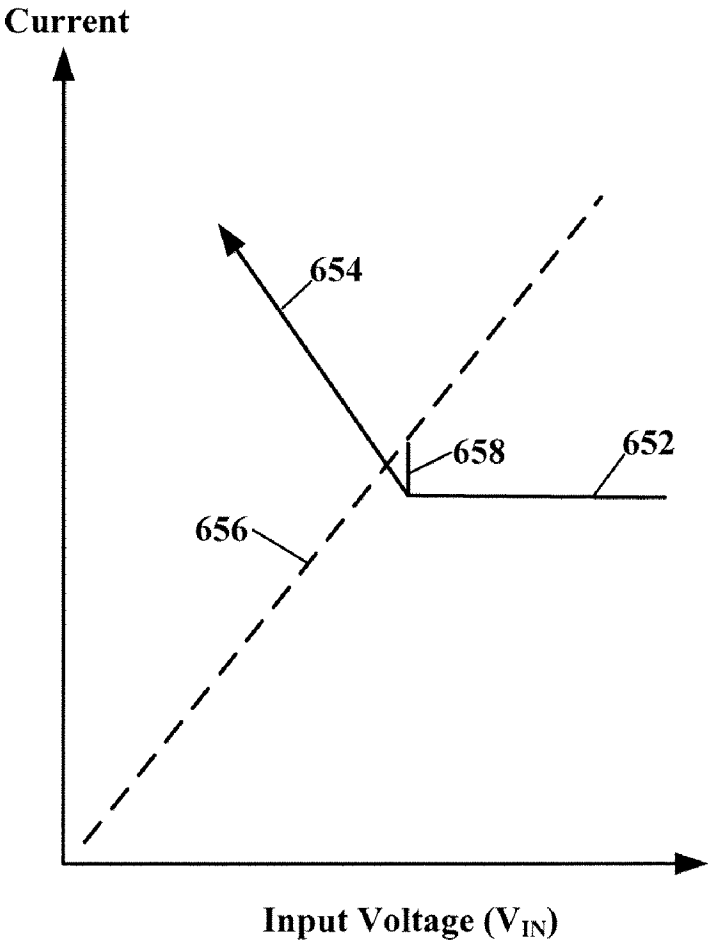
FIG. 6 illustrates a schematic graph of the voltage and current relationships with and without the LDO bypass current saving features according to the teachings of this disclosure.

Without the implementation of the teachings of this disclosure, current consumption becomes extremely high when the input voltage is less than the reference voltage and the regulator switches to track mode. FIG. 6 shows this rapid current increase, when the input voltage is less than the reference voltage, as the solid line 654 in the left half portion of the graph. When the above mentioned techniques are implemented, the current consumption becomes a linear function (current mainly drawn by logic circuits of the integrated circuit) of $V_{IN}$, which is depicted as the dashed line 656 shown in FIG. 6.

When $V_{IN}$ goes higher than 3.6 volts, the voltage monitor and control 512 causes the LDO bypass voltage regulator 500 to go back into the regulate mode where the buffer 504, the error amplifier 506 and the power pass element 502 function as a closed loop voltage regulator, as described hereinabove, thereby keeping $V_{OUT}$ at about 3.3 volts (e.g., approximately the voltage value of the voltage reference 508). It is contemplated and within the scope of this disclosure that any voltage value at $V_{OUT}$ may be maintained so long as the voltage at the $V_{IN}$ node is high enough for the regulation circuit to operate properly.

Figure 7:
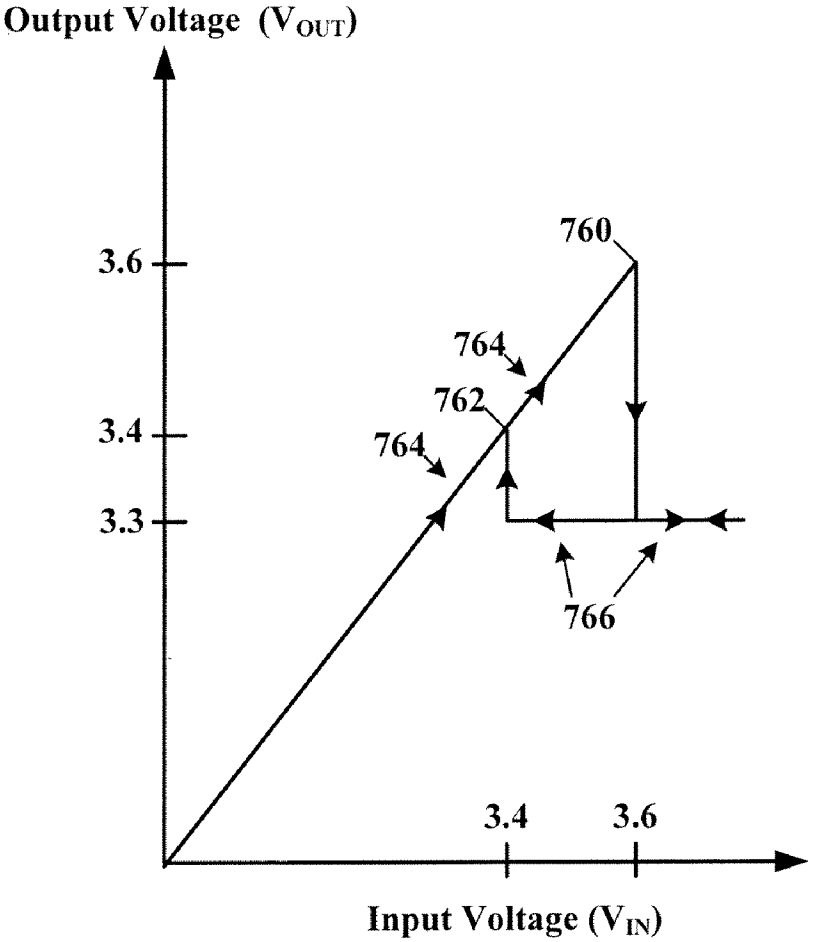
FIG. 7 illustrates a schematic graph of input and output voltage relationships with the LDO in the regulation or bypass mode and having voltage hysteresis therebetween, according to the teachings of this disclosure.

Referring to FIG. 7, depicted is a schematic graph of input and output voltage relationships with the LDO in the regulation or bypass mode and having voltage hysteresis therebetween, according to the teachings of this disclosure. When in the regulation mode, the output voltage remains substantially at the regulation voltage, e.g., 3.3 volts, generally represented by the numeral 766. In the graph shown in FIG. 7 the LDO remains in the regulation mode for input voltages down to about 3.4 volts (762). Once the input voltage goes below about 3.4 volts the LDO goes into the bypass mode and the output voltage tracks the input voltage, generally represented by the numeral 764, wherein the LDO is shutdown and draws an insignificant amount of current. The LDO remains in the shutdown mode until the input voltage goes back to about 3.6 volts (760) and then the LDO will switch back to the regulation mode. Therefore, hysteresis may be used for switching between the regulation and bypass modes of the LDO. The voltages depicted in FIG. 7 are used as an example, but many other combinations of upper and lower voltages for a hysteresis function may be used and are contemplated herein.

While embodiments of this disclosure have been depicted, described, and are defined by reference to example embodiments of the disclosure, such references do not imply a limitation on the disclosure, and no such limitation is to be inferred. The subject matter disclosed is capable of considerable modification, alteration, and equivalents in form and function, as will occur to those ordinarily skilled in the pertinent art and having the benefit of this disclosure. The depicted and described embodiments of this disclosure are examples only, and are not exhaustive of the scope of the disclosure.

What is claimed is:

1. A low drop out (LDO) bypass voltage regulator in an integrated circuit device, comprising:

a power pass element, the power pass element having a power input, a power output and a control input, wherein the power input is coupled to a voltage source and the power output is coupled to a load;

a buffer having an input and an output, wherein the output of the buffer is coupled to the control input of the power pass element;

an error amplifier having a positive input, a negative input and an output, wherein the output of the error amplifier is coupled to the input of the buffer, the negative input is coupled to a voltage reference and the positive input is coupled to a sampled voltage of the power output of the power pass element; and a voltage monitor and control circuit having a first control output, a second control output and a voltage sensing input, wherein the voltage sensing input is coupled to the voltage source, the first control output is coupled to the buffer and the second control output is coupled to the power pass element, wherein when the voltage source is above a first voltage value the buffer is enabled, and the power pass element, buffer and error amplifier regulate a load voltage, and when the voltage source is less than a second voltage value the buffer is disabled and the power pass element is placed into a pass-through state so that the load voltage follows the source voltage and is not regulated.

2. The LDO bypass voltage regulator, according to claim 1, wherein the power pass element is a P-channel metal oxide semiconductor (PMOS) power transistor.

3. The LDO bypass voltage regulator, according to claim 1, wherein the voltage monitor and control circuit comprises a hysteresis circuit that prevents re-enabling the buffer, and keeps the power pass element in the pass-through state until the source voltage is above the first voltage value that is greater than the second voltage value.

4. The LDO bypass voltage regulator, according to claim 1, wherein the first voltage value is about 3.6 volts and the second voltage is about 3.4 volts.

5. The LDO bypass voltage regulator, according to claim 1, wherein the voltage reference comprises a bandgap voltage reference.

6. The LDO bypass voltage regulator, according to claim 1, wherein when the buffer is disabled its output is a high impedance.

7. The LDO bypass voltage regulator, according to claim 1, wherein the buffer has a current mirror, wherein the current mirror is disabled when the buffer is disabled.

8. The LDO bypass voltage regulator, according to claim 1, wherein the power pass element, the buffer, the error amplifier, the voltage reference, and the voltage monitor and control circuit are fabricated on an integrated circuit die.

* * * * *